US006149401A

United States Patent [19]

Iwanami et al.

[11] Patent Number: 6,149,401

[45] Date of Patent: Nov. 21, 2000

[54] VARIABLE DISCHARGE-AMOUNT COMPRESSOR FOR REFRIGERANT CYCLE

[75] Inventors: Shigeki Iwanami, Okazaki; Takeshi Sakai, Chiryu, both of Japan

[73] Assignee: Denso Corporation, Kariya, Japan

[21] Appl. No.: 09/176,428

[22] Filed: Oct. 21, 1998

[30] Foreign Application Priority Data

Oct. 27, 1997 [JP] Japan ..... 9-294504

[51] Int. Cl.[7] ..... F04B 49/00

[52] U.S. Cl. ..... 417/307; 417/306; 417/213; 417/222.2; 417/440

[58] Field of Search ..... 417/306–311, 213, 417/222.2, 440

[56] References Cited

U.S. PATENT DOCUMENTS

| | | | |
|---|---|---|---|
| Re. 35,672 | 11/1997 | Taguchi | 417/222.2 |
| 4,526,516 | 7/1985 | Swain et al. | 417/222.2 |
| 4,865,866 | 9/1989 | Moore | 426/602 |
| 5,059,097 | 10/1991 | Okazaki et al. | 417/222.2 |
| 6,015,269 | 1/2000 | Ota et al. | 417/222.2 |
| 6,074,173 | 6/2000 | Taguchi | 417/222.2 |

FOREIGN PATENT DOCUMENTS 2-55636 11/1990 Japan .

*Primary Examiner*—Teresa Walberg
*Assistant Examiner*—Jeffrey Pwu
*Attorney, Agent, or Firm*—Pillsbury Madison & Sutro LLP

[57] ABSTRACT

A variable discharge-amount compressor includes a compression unit for compressing refrigerant, and a discharge-amount varying unit for varying a discharge amount of refrigerant discharged from the compression unit. The discharge-amount varying unit has a first control room communicating with inlet and outlet of the compression unit, a second control room communicating with the inlet, and a third control room communicating with the second control room through a orifice. The first control room communicates with the inlet through a control passage opened and closed by a control valve. Further, a bypass passage communicating with the inlet is opened when the control passage is opened. Therefore, when an engine for driving the compressor is rotated to be accelerated, a pressure difference is generated between a pressure inside the second control room and a pressure inside the third control room, thereby opening the control passage and the bypass passage. Thus, the compressor can reduce a discharge amount of refrigerant during an acceleration of the engine without any extra detector or control device, resulting in a low production cost.

10 Claims, 6 Drawing Sheets

VARIABLE DISCHARGE-AMOUNT COMPRESSOR FOR REFRIGERANT CYCLE

CROSS-REFERENCE TO RELATED APPLICATION

This application relates to and incorporates herein by reference Japanese Patent Application No. Hei. 9-294504 filed on Oct. 27, 1997.

BACKGROUND OF THE INVENTION

1. Field of the Invention

The present invention relates to a variable discharge-amount compressor that can vary a discharge amount of refrigerant. The variable discharge-amount compressor is applied to a refrigerant cycle of an air conditioner for a vehicle.

2. Related Art

A conventional compressor of an air conditioner for a vehicle is driven by an engine for traveling the vehicle. JP-B2-2-55636 discloses a variable discharge-amount compressor which reduces a discharge amount of refrigerant during an acceleration of the vehicle to prevent deterioration in acceleration performance of the vehicle and in air-conditioning performance of the air conditioner.

However, in the variable discharge-amount compressor, the discharge amount of refrigerant is varied by controlling an electromagnetic valve according to a detected operation state of the engine such as an engine load. Therefore, the variable discharge-amount compressor requires a detecting unit such as a sensor for detecting the engine operation state, and a control unit for controlling the electromagnetic valve according to the detected value of the detecting unit, resulting in a high production cost of the compressor.

SUMMARY OF THE INVENTION

In view of the foregoing problems, it is an object of the present invention to provide a variable discharge-amount compressor which reduces a discharging amount of refrigerant when a rotation speed of the compressor is accelerated during an acceleration of a vehicle, and is produced in a low cost.

According to the present invention, a variable discharge-amount compressor for a refrigerant cycle has a compression unit and a discharge-amount varying unit. The compression unit has an inlet for sucking refrigerant, an outlet for discharging refrigerant and a compression room in which refrigerant is sucked and compressed. The discharge-amount varying unit for varying a discharge amount of refrigerant discharged from the compression unit includes a first control room communicating with the inlet and outlet of the compression unit, a control passage through which the first control room communicates with either one of the inlet and outlet of the compression unit, a valve for opening and closing the control passage, a second control room for applying a pressure to the valve so that the control passage is closed, a third control room for applying a pressure to the valve so that the control passage is opened, and an elastic member for applying an elastic force to the valve so that the control passage is closed. Either one of the inlet and outlet communicates with either one of the second and third control rooms. The second and third control rooms communicate with each other to have a pressure difference therebetween when a rotation speed of the compression unit is accelerated, and the discharge-amount varying unit reduces the discharge amount of refrigerant from the compression unit according to a pressure variation of the first control room. Therefore, during an acceleration of the engine for driving the compressor, the rotation speed of the compression unit is accelerated so that the pressure difference between the second and third control rooms is generated. Thus, the control passage is opened by the pressure difference, and the pressure in the first control room is changed so that the discharge amount of refrigerant of the compressor is reduced. Accordingly, the compressor can reduce the discharge amount during an acceleration of a vehicle driven by the engine without any detector for detecting the operation state of the engine, resulting in a low production cost.

Preferably, the second and third control rooms communicate with each other through throttle means formed in the valve. Therefore, the pressure difference between the second and third control rooms can be readily generated when the engine for driving the compressor is accelerated.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Preferred embodiments of the present invention are described hereinafter with reference to the accompanying drawings.

Figure 1:
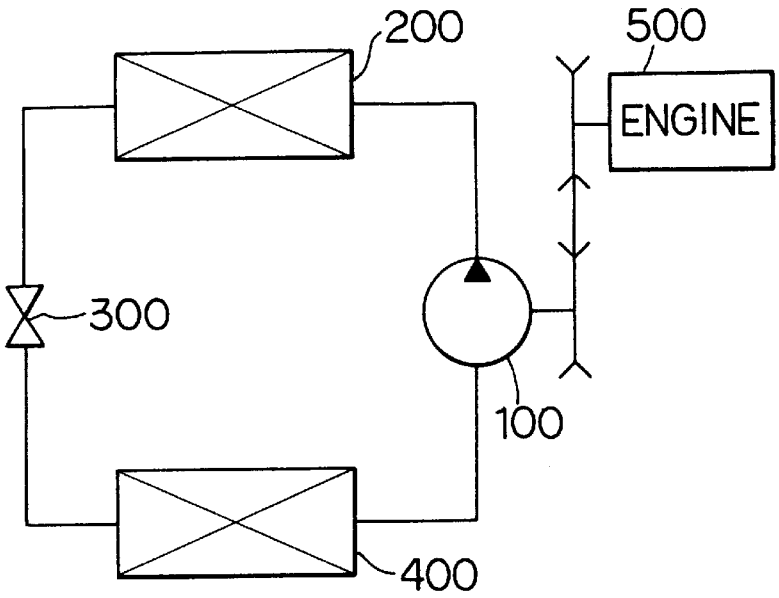
FIG. 1 is a diagrammatic view showing a refrigerant cycle for a vehicle according to a first preferred embodiment of the present invention.

A first preferred embodiment of the present invention will be described with reference to FIGS. 1–6. As shown in FIG. 1, a refrigerant cycle for a vehicle includes an variable discharge-amount compressor 100 (hereinafter referred to as compressor 100), a condenser 200 as a radiator for cooling refrigerant discharged from the compressor 100, an expansion valve 300 as a decompressing unit for decompressing refrigerant from the condenser 200, and an evaporator 400 for evaporating liquid refrigerant decompressed by the expansion valve 300. An opening degree of the expansion valve 300 is adjusted so that a heating degree of refrigerant discharged from the evaporator 400 is set to a predetermine degree.

The compressor 100 is driven by an engine 500 for driving the vehicle through a V-belt and an electromagnetic clutch (not shown).

Figure 2:
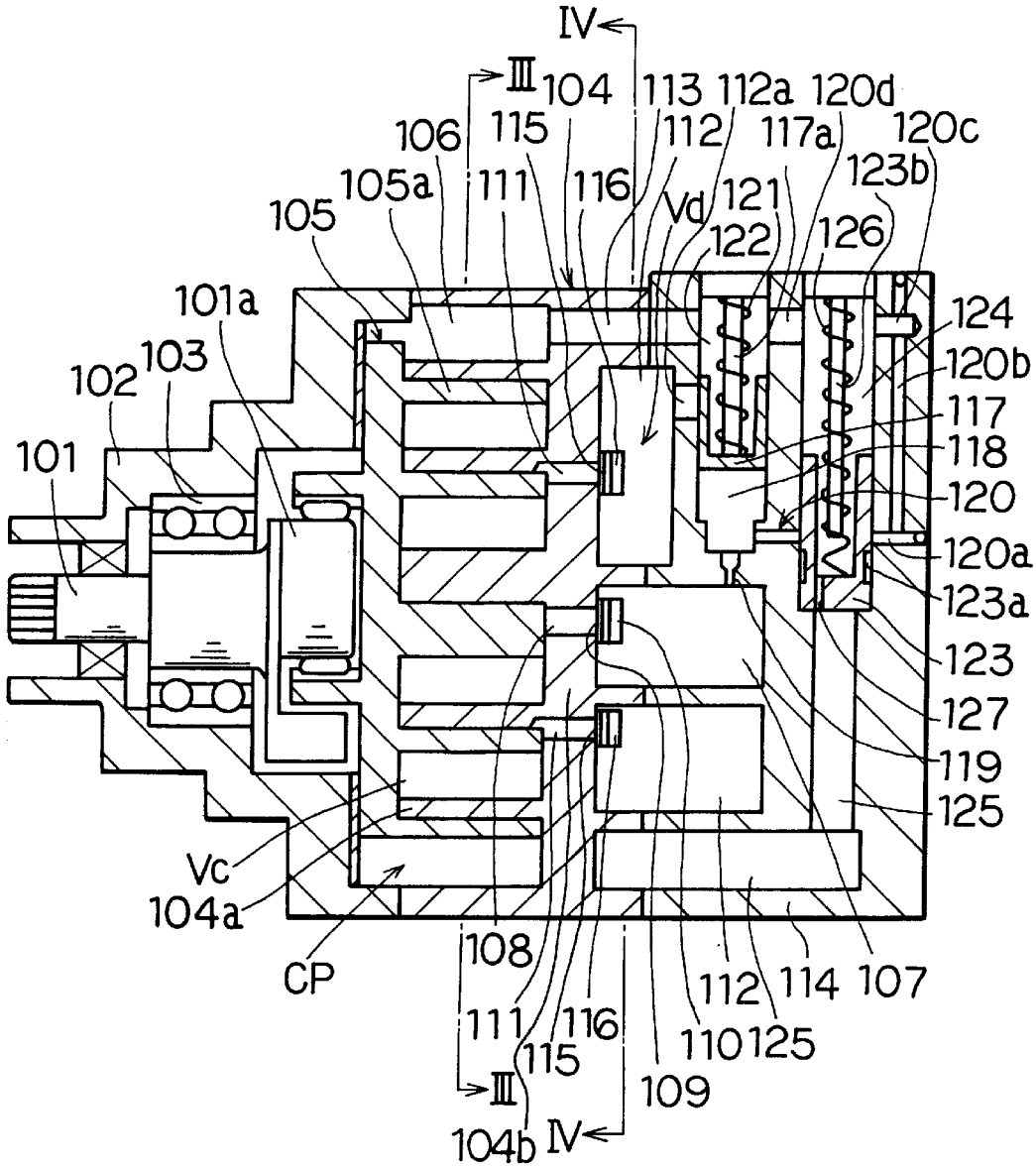
FIG. 2 is a cross-sectional view showing a variable discharge-amount compressor according to the first embodiment.

As shown in FIG. 2, the compressor 100 has a shaft 101 driven and rotated by the engine 500 through the electromagnetic clutch. A bearing 103 for rotatably supporting the shaft 101 is provided in a front housing 102. A stationary scroll portion 104 having a spiral-shaped teeth portion 104*a* is fixed to the front housing 102.

A movable scroll portion 105 having a spiral-shaped teeth portion 105*a* which engages with the teeth portion 104*a* is disposed in a space between the stationary scroll portion 104 and the front housing 102. The movable scroll portion 105 is rotatably attached to a crank portion 101*a* (eccentric portion) displaced from a rotation center of the shaft 101 by a preset distance.

When the movable scroll portion 105 rotates around the shaft 101 as the shaft 101 rotates, the compressor 100 sucks and compresses refrigerant by increasing and decreasing a volume of a compression room (Vc) defined by the stationary scroll portion 104 and the movable scroll portion 105. A compression unit (CP) including the stationary and movable scroll portions 104, 105, for sucking and compressing refrigerant, is used as a compression mechanism.

Further, a suction room 106 communicates with an inlet (not shown) of the compressor 100, connected to an outlet of the evaporator 400. A discharge room 107 communicates with an outlet (not shown) of the compressor 100, connected to an inlet of the condenser 200. The discharge room 107 communicates with the compression room (Vc) through a discharge port 108 formed on an end plate portion 104*b* of the stationary scroll portion 104. In the discharge port 108 on the end adjacent to the discharge room 107, there is provided with a reed-shaped discharge valve 109 for preventing refrigerant from flowing from the discharge room 107 to the compression room (Vc). The discharge valve 109 is tightened and fixed to the end plate portion 104*b* together with a valve stopper plate 110 which sets a maximum opening degree of the discharge valve 109.

Figure 3:
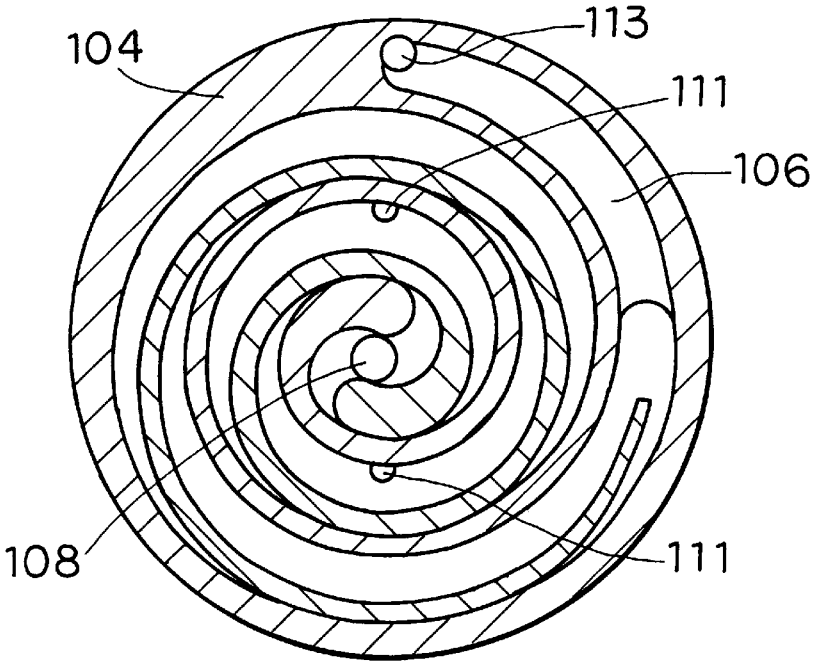
FIG. 3 is a cross-sectional view taken along line III—III in FIG. 2.
Figure 4:
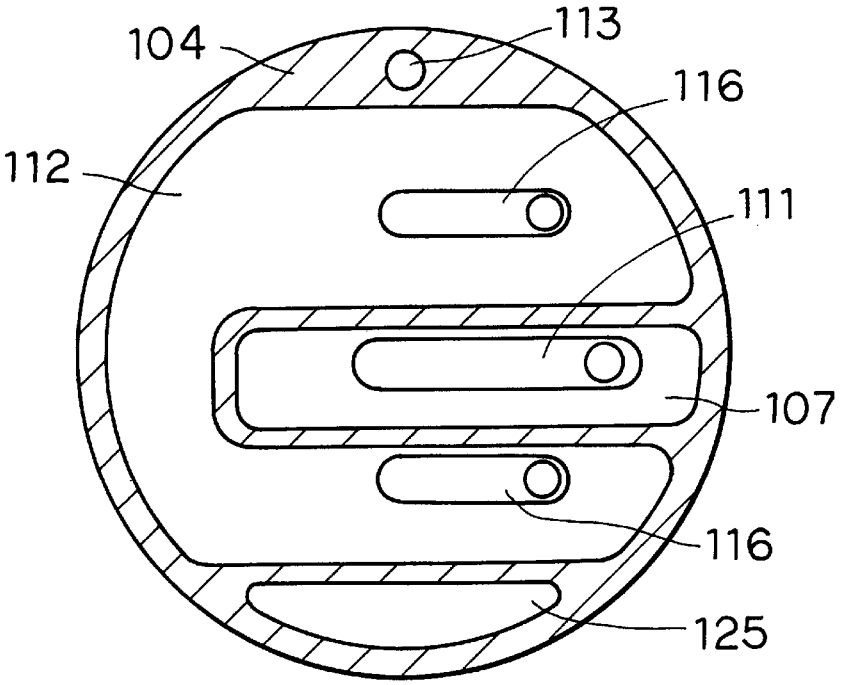
FIG. 4 is a cross-sectional view taken along line IV—IV in FIG. 2.

The end plate portion 104*b* also has a bypass port 111 communicating with the compression room (Vc), as shown in FIGS. 2 and 3. The bypass port 111 communicates with the suction room 106 through an intermediate room 112 and a bypass passage 113, as shown in FIGS. 2 and 4. The intermediate room 112 and the bypass passage 113 are formed by the stationary scroll portion 104 and a rear housing 114 fixed to the stationary scroll portion 104.

A reed-shaped bypass valve 115 for opening and closing the bypass port 111 is disposed in the bypass port 111 on the end adjacent to the intermediate room 112. The bypass valve 115 closes the bypass port 111 when a pressure inside the intermediate room 112 is higher than a pressure inside the compression room (vc) communicating with the bypass port 111, and opens the bypass port 111 when the pressure inside the intermediate room 112 is lower than the pressure inside the compression room (Vc) communicating with the bypass port 111. A valve stopper plate 116 for setting a maximum opening degree of the bypass valve 115 is also tightened and fixed to the end plate portion 104*b* together with the bypass valve 115.

Further, a spool-shaped bypass valve 117 which opens and closes the bypass passage 113 or an intermediate room port 112*a* of the intermediate room 112 is slidably disposed for the bypass passage 113. A first control room 118 is formed by the bypass valve 117 and the rear housing 114. The first control room 118 controls opening and closing of the bypass valve 117, and communicates with both the discharge room 107 (i.e., outlet) and the suction room 106 (i.e., inlet).

The first control room 118 and the discharge room 107 constantly communicate with each other through a first orifice 119. The first orifice 119 is a small hole formed in the rear housing 114 and generates a relatively large pressure loss. That is, a flow of refrigerant between the first control room 118 and the discharge room 107 is restricted by the first orifice 119. The first control room 118 and the suction room 106 also communicate with each other through a control passage consisting of passages 120*a*, 120*b*, 120*c*, 120*d*.

A control rear room 122 into which a pressure inside the suction room 106 is introduced is formed to be opposite to the first control room 118, and the bypass valve 117 is positioned between the control rear room 122 and the first control room 118. A first coil spring 121 is formed in the control rear room 122 so that an elastic force of the first coil spring 121 is applied to the bypass valve 117 in a direction for reducing a volume of the first control room 118. Therefore, when the pressure inside the first control room 118 is higher than a pressure inside the control rear room 122, the bypass passage 113 or the intermediate room port 122*a* is closed. On the other hand, when the pressure inside the first control room 118 is equal to or lower than the pressure inside the control rear room 122, the bypass passage 113 or the intermediate room port 122*a* is opened. A stopper 117*a* is used to set a stop position of the bypass valve 117, so that the bypass valve 117 closes the intermediate room port 112*a* at the stop position when the pressure inside the first control room 118 is higher than the pressure inside the control rear room 122.

Further, a spool-shaped control valve 123 which opens and closes the passage 120*a* of the control passage 120 is slidably disposed in the control passage 120. A second control room 124 is formed on one side of the control valve 123, and a third control room 125 is formed on the other side of the control valve 123. A pressure within the second control room 124 is applied to the control valve 123 in a direction for closing the passage 120*a*. A pressure within the third control room 125 is applied to the control valve 123 in a direction for opening the passage 120*a*.

The second control room 124 communicates with the suction room 106 through the passage 120*d*. A second coil spring 126 is disposed in the second control room 124 so that an elastic force of the second coil spring 126 is applied to the control valve 123 in the direction for closing the control passage 120*a*. On the other hand, the third control room 125 communicates with the second control room 124 through a second orifice 127 formed in the control valve 123. The second orifice 127 is a small hole, and restricts the flow of refrigerant between the second and third control rooms 124, 125. Therefore, when the pressure inside the second control room 124 (i.e., the suction room 106) changes, a pressure inside the third control room 125 changes with a preset time delay (i.e., response delay). Accordingly, when the pressure inside the suction room 106 (the second control room 124) rapidly changes due to an acceleration of the engine 500 or the like, a pressure difference $\Delta P$ (herein after referred to as control pressure $\Delta P$) between the pressure inside the second control room 124 and the pressure inside the third control room 125 is generated.

In the first embodiment, the third control room 125 is formed to have a sufficiently large volume so that the control pressure ΔP is sufficiently large to slidably move the control valve 123. Further, the control valve 123 has a circular groove 123*a* on an outer circumferential surface, which forms a part of the passage 120*a* when the passage 120*a* is opened. A stopper 123*b* is used to set a stop position of the control valve 123. At the stop position, the control valve 123 opens the passage 120*a* when the control pressure ΔP is generated between the second and third control rooms 124, 125 due to a rapid change in a rotation speed of the engine 500 or the like. In the first embodiment, a discharge-amount varying unit (Vd) including the control rooms 118, 124, 125 and the control passage 120 is used as a discharge-amount varying function for varying the amount of refrigerant discharged from the compression unit (CP).

Next, operation of the compressor 100 according to the first embodiment will be now described.

When the engine 500 is accelerated, a rotation speed of the compression unit (CP) including the scroll portions 104, 105 rapidly increases as the rotation speed of the engine 500 increases, thereby increasing a discharge amount of refrigerant of the compressor 100 per unit period. However, the opening degree of the expansion valve 300 mechanically changes according to the heating degree of refrigerant at an outlet of the evaporator 400. Therefore, the opening degree of the expansion valve 300 does not change immediately even if the rotation speed of the engine 500 changes. As a result, the pressure inside the suction room 106 (the second control room 124) rapidly decreases, and the pressure difference between the second and third control rooms 124, 125 is larger than the control pressure ΔP so that the passage 120*a* is opened.

Figure 5:
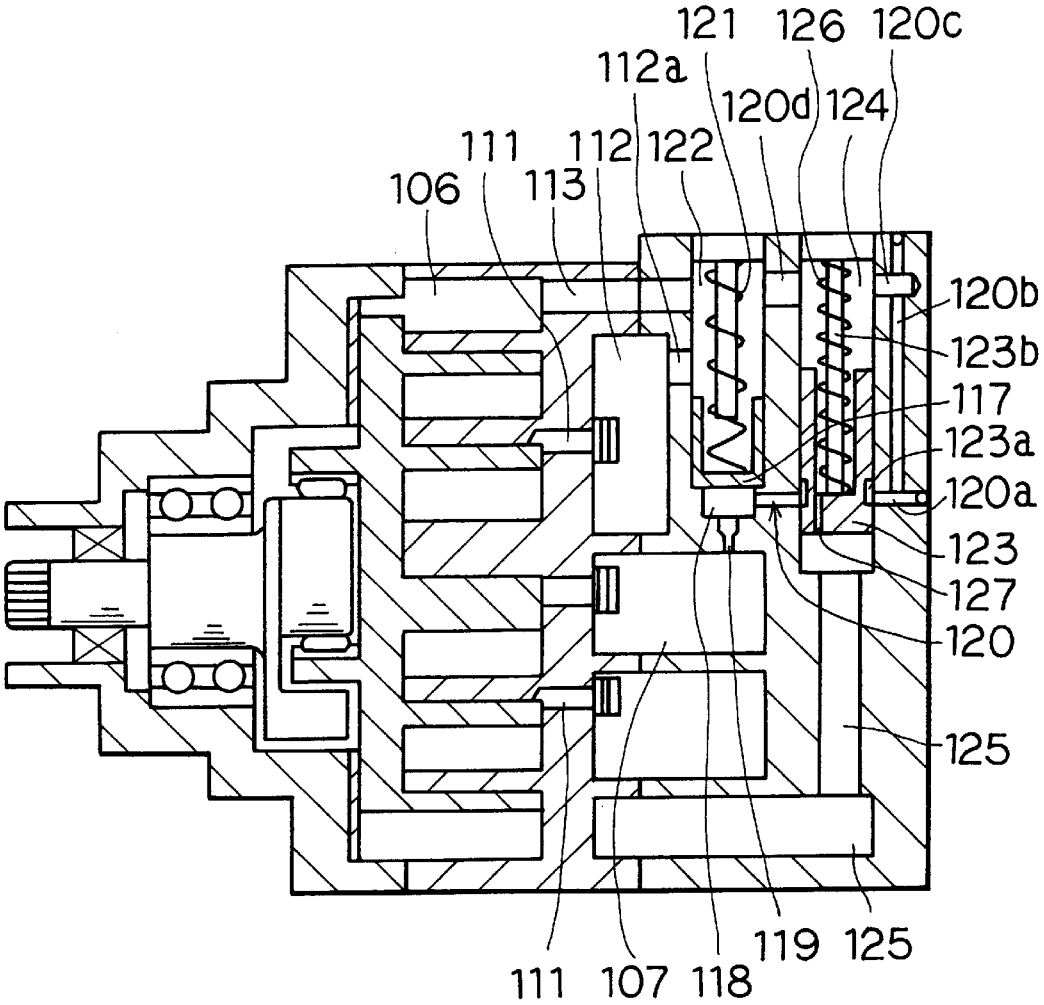
FIG. 5 is a cross-sectional view showing the variable discharge-amount compressor during an acceleration of an engine according to the first embodiment.

Therefore, as shown in FIG. 5, the first control room 118 communicates with the suction room 106. Thus, the pressure inside the first control room 118 is reduced, and the bypass valve 117 slides so that the bypass passage 113 (i.e., the intermediate room port 112*a*) is opened. Accordingly, the pressure inside the intermediate room 112 decreases and refrigerant inside the compression room (Vc) reverses into the suction room 106 through the bypass port 111, resulting in that the discharge amount of the compressor 100 virtually decreases. That is, the compressor 100 is in a variable discharge-amount operation state.

When the rotation speed of the engine 500 becomes steady, the pressure inside the second control rooms 124 and the pressure inside the third control room 125 become equal, resulting in that the control pressure ΔP becomes 0. Therefore, the passage 120*a* and the bypass passage 113 (the intermediate room port 112*a*) are closed, thereby increasing the discharge amount of the compressor 100. That is, the compressor 100 is in a maximum operation state.

According to the first embodiment of the present invention, the compressor 100 can reduce the discharge amount of refrigerant during an acceleration of the vehicle without any sensor for detecting an operation state of the engine 500 or any control unit for controlling the electromagnetic valve according to the detected value. Thus, the compressor 100 can reduce the discharge amount during the acceleration of the vehicle, and can be produced in low cost.

Further, in the first embodiment, the compressor 100 reduces the discharge amount by directly varying the discharge amount. Therefore, the compressor 100 more effectively improves acceleration performance of the vehicle and air conditioning performance of the air conditioner in comparison with a compressor which reduces the discharge amount to 0 by turning off an electromagnetic clutch during an acceleration of a vehicle.

Figure 6:
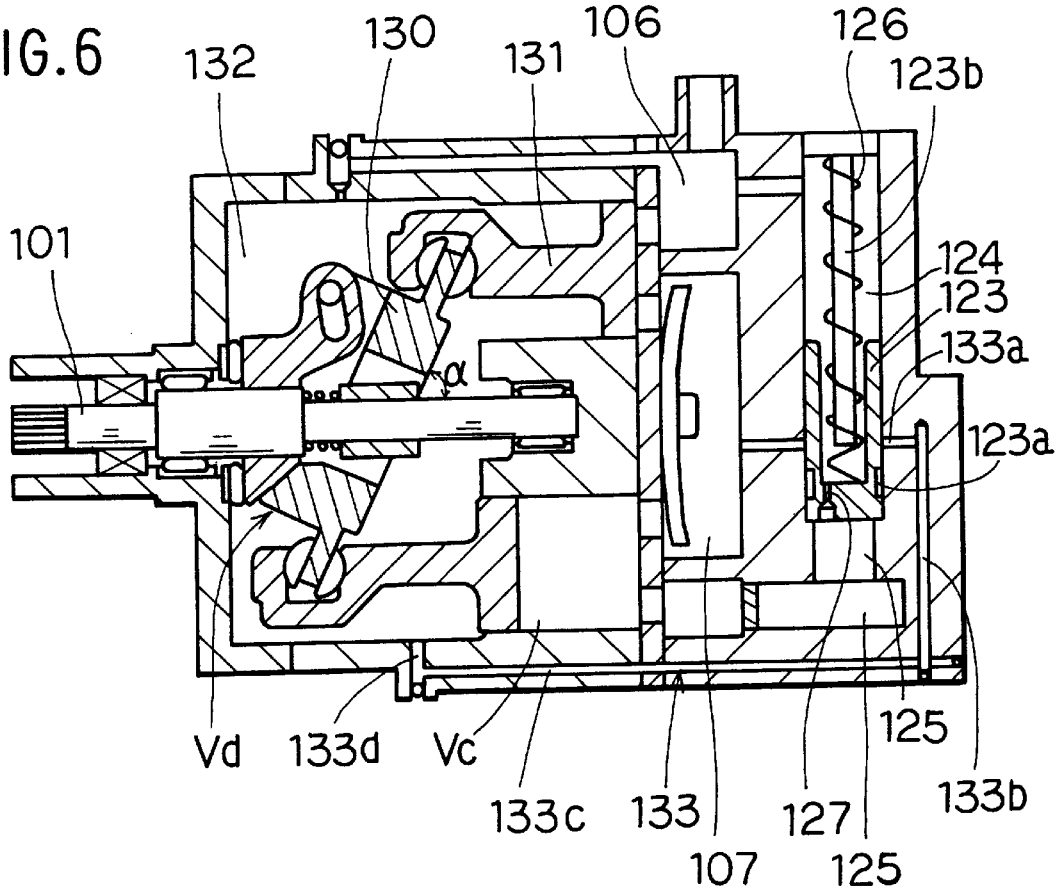
FIG. 6 is a cross-sectional view showing a variable discharge-amount compressor according to a second preferred embodiment of the present invention.

A second preferred embodiment of the present invention will be described with reference to FIG. 6. In this and following embodiments, components which are similar to those in the first embodiment are indicated with the same reference numerals, and the explanation thereof is omitted.

In the second embodiment, the present invention is applied to a variable discharge-amount compressor for an inclined plate type (hereinafter referred to as inclined plate compressor). As shown in FIG. 6, the inclined plate compressor has an inclined-plate compression unit (CP) consisting of an inclined plate 130 which rotates integrally with the shaft 101, a piston 131 activated and reciprocated by the inclined plate 130, and the like. The inclined plate compressor also has a variable discharge-amount unit (Vd) which changes the discharge amount of refrigerant from the inclined plate compressor by changing an inclination angle α of the inclined plate 130 with respect to the shaft 101.

In the second embodiment, a pressure inside an inclined plate room 132 in which the inclined plate 130 is disposed, is controlled by the control valve 123, similarly to the first embodiment. That is, the inclined plate room 132 corresponds to the first control room 118 in the first embodiment. The discharge amount of the inclined plate compressor is decreased when the pressure inside the inclined plate room 132 becomes higher than the pressure inside the suction room 106, and is increased when the pressure inside the inclined plate room 132 becomes equal to the pressure inside the suction room 106. Therefore, in the second embodiment, the discharge room 107 communicates with the inclined plate room 132 through a control passage 133 consisting of passages 133*a*, 133*b*, 133*c*, 133*d*, and the control valve 123 opens and closes the passages 133*a*, 133*b*, 133*c*, 133*d*.

Next, operation of the second embodiment of the present invention will be described. According to the second embodiment, when the engine 500 is accelerated, the pressure difference between the second and third control rooms 124, 125 becomes larger than the control pressure ΔP, similarly to the first embodiment. That is, when the engine 500 is accelerated, the control pressure ΔP is generated between the second and third control rooms 124, 125. As a result, the control passage 133 is opened and the pressure inside the discharge room 107 is introduced into the inclined plate room 132, resulting in that the pressure inside the inclined plate room 132 becomes higher than the pressure inside the suction room 106. Therefore, the inclination angle α is changed to be substantially 90 degrees with respect to the shaft 101, and the discharge amount of refrigerant from the inclined plate compressor is decreased. That is, the inclined plate compressor is in the variable amount operation state.

When the rotation speed of the engine 500 becomes steady, the pressure inside the second control room 124 and the pressure inside the third control room 125 become equal, while the control pressure ΔP is reduced to 0. Therefore, the control passage 133 is closed, the inclination angle α of the inclined plate 130 is decreased, and the discharge amount of refrigerant from the inclined plate compressor is increased. That is, the inclined plate compressor is in the maximum operation state where the discharge amount is increased at a predetermined level.

Figure 7:
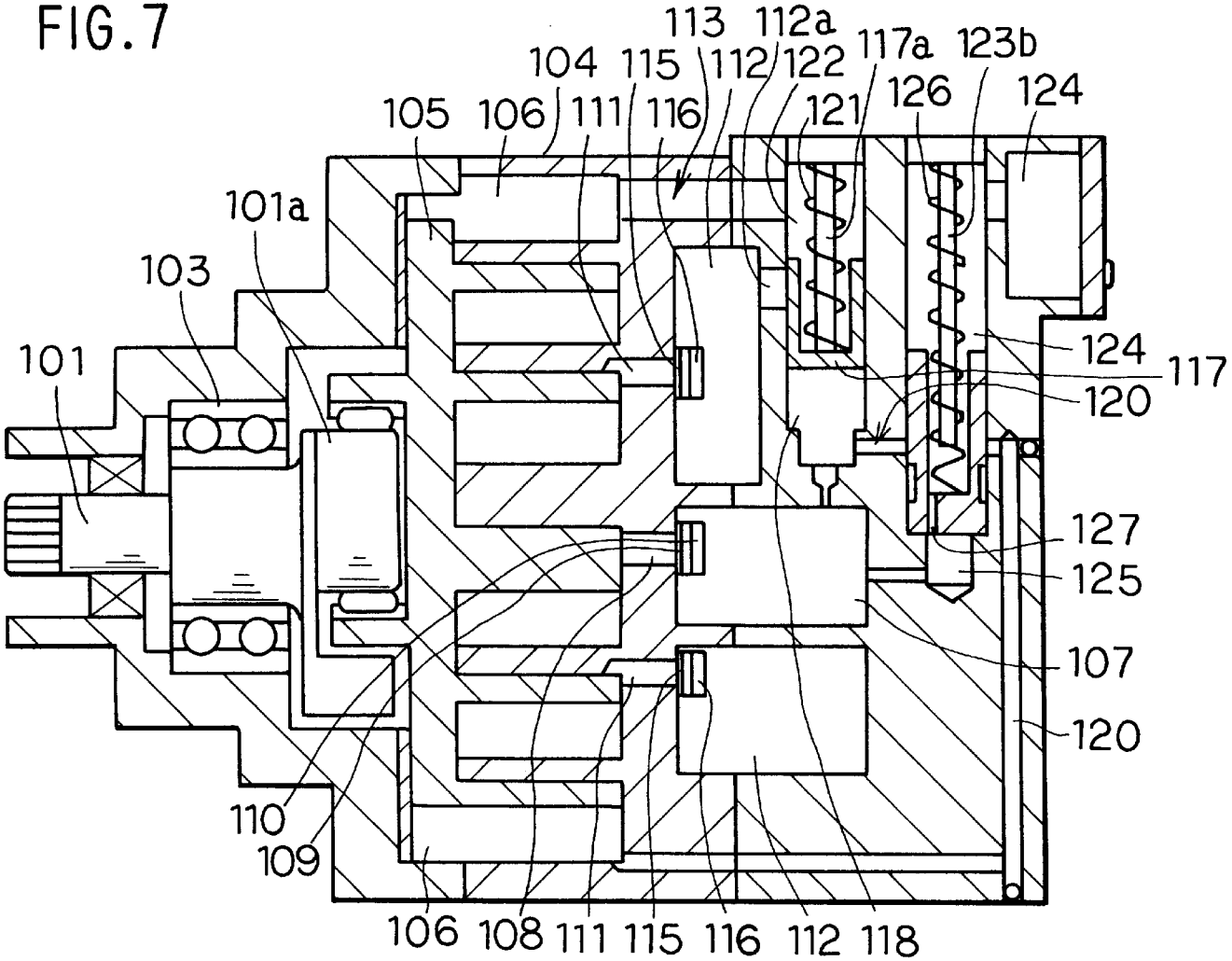
FIG. 7 is a cross-sectional view showing a variable discharge-amount compressor according to a third preferred embodiment of the present invention.

A third preferred embodiment of the present invention will be described with reference to FIG. 7. In the first and second embodiments, the control valve 123 is opened and closed according to a rapid change of the pressure inside the suction room 106 due to an acceleration of the rotation speed of the engine 500 (that is, the acceleration of the vehicle). However, in the third embodiment, the control valve 123 is opened and closed according to a rapid change of the pressure inside the discharge room 107 due to an acceleration of the rotation speed of the engine 500. As shown in FIG.7, a scroll-type compressor similar to the compressor 100 in the first embodiment is used in the third embodiment. The second and third control rooms 124, 125 communicate with the discharge room 107 through the second orifice 127. In the third embodiment, the second control room 124 has a sufficiently large volume so that the control pressure ΔP is readily generated.

When the engine 500 is accelerated, the rotation speed of the compression unit of the compressor rapidly increases as the rotation speed of the engine 500 increases, thereby rapidly increasing the pressure inside the discharge room 107. As a result, the control pressure ΔP is generated to open the control passage 120, thereby virtually decreasing the discharge amount of the compressor similarly to the first embodiment. That is, the compressor is in the variable discharge-amount operation state.

When the rotation speed of the engine 500 becomes stable, the pressure inside the second control room 124, and the pressure inside the third control room 125 become equal so that the control pressure ΔP is reduced to 0. Therefore, the control passage 120 is closed and the discharge amount of refrigerant from the compressor increases at a predetermined level. In this case, the compressor is in the maximum operation state.

Figure 8:
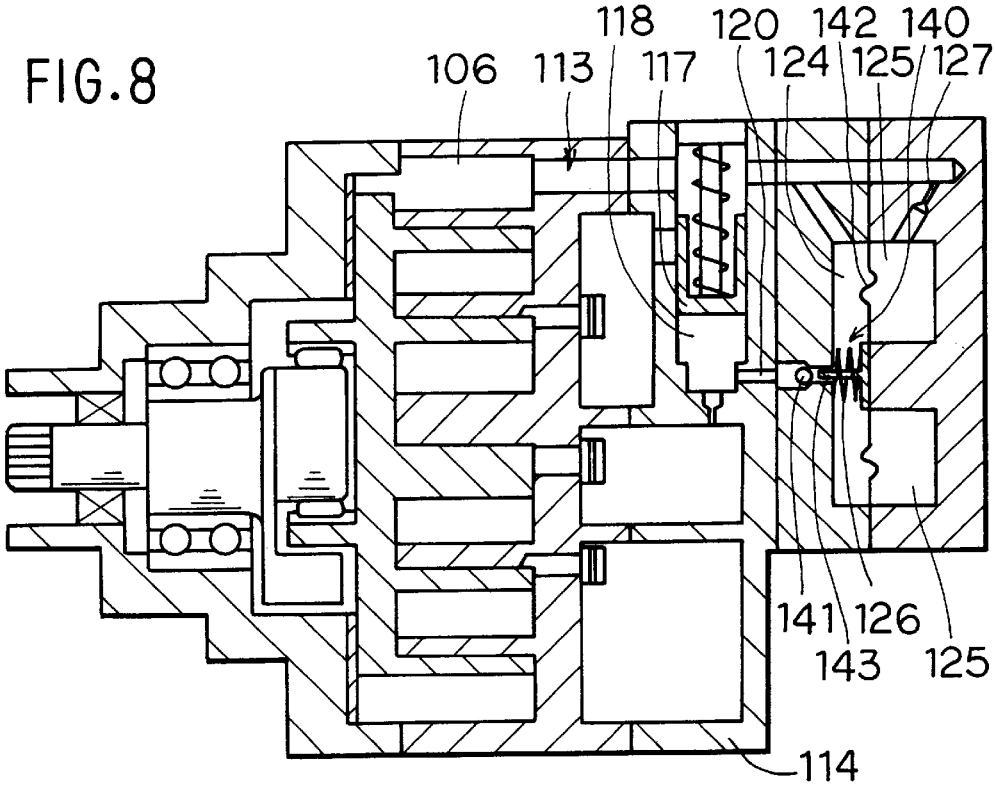
FIG. 8 is a cross-sectional view showing a variable discharge-amount compressor according to a fourth preferred embodiment of the present invention.
Figure 9:
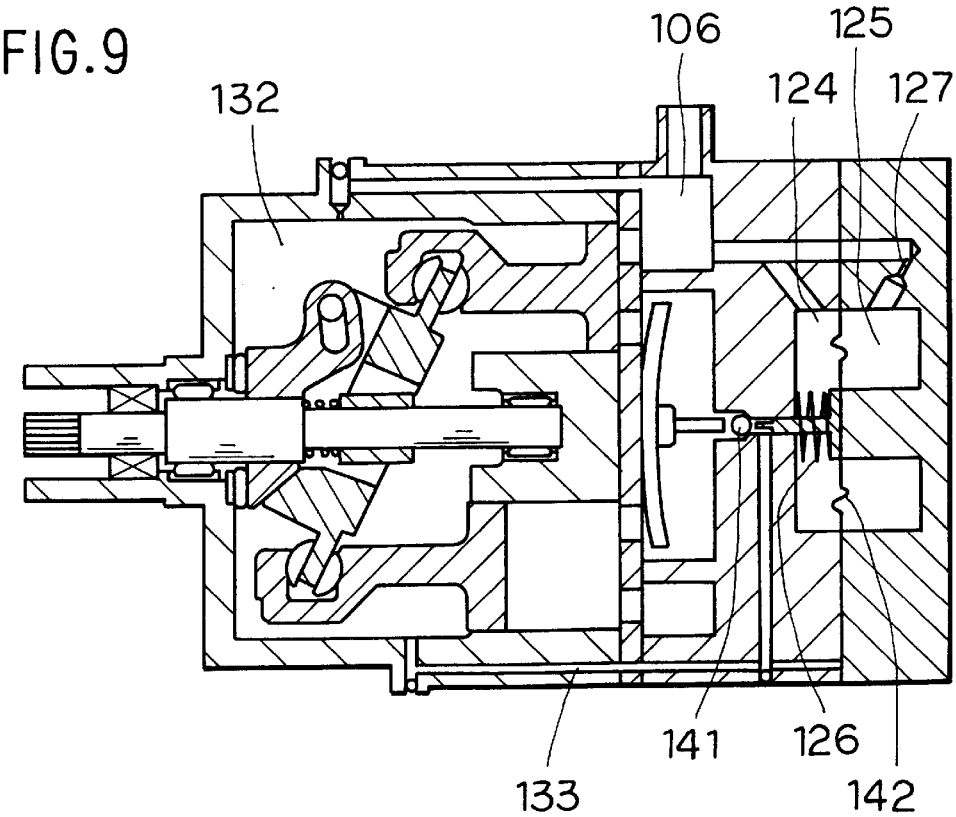
FIG. 9 is a cross-sectional view showing a variable discharge-amount compressor according to the fourth embodiment.

A fourth preferred embodiment of the present invention will be described with reference to FIGS. 8, 9. In each of the above-described embodiments, the control valve 123 is the spool-shaped valve. In the fourth embodiment, as shown in FIGS. 8, 9, a compressor has a control valve 140 having a sphere-shaped valve body 141 and a diaphragm 142 made of a thin-film for moving the valve body 141. The diaphragm 142 moves in response with pressure. Further, the second orifice is not formed in the control valve 140, but is formed in the rear housing 114.

FIG. 8 shows a scroll compressor according to the fourth embodiment, similar to the compressor 100 of the first embodiment. FIG. 9 shows an inclined plate compressor according to the forth embodiment, similar to that of the second embodiment. The operation of the compressor according to the fourth embodiment is similar to the operation of the compressor according to the first and second embodiments, except for the operation of the control valve 140. Therefore, the operation of the control valve 140 will be mainly described with reference to FIG. 8.

When the engine 500 is in a steady operation state with a steady rotation speed, the valve body 141 closes the control passage 120 due to a pressure difference between the pressure inside the first control room 118 (i.e., a discharge pressure), and the pressure inside the second control room 124 (i.e., a suction pressure).

When the engine 500 is accelerated, the control pressure ΔP occurs between the second and third control rooms 124, 125, and the diaphragm 142 is displaced from the third control room 125 to the second control room 124. Therefore, a push rod 143 connected to the diaphragm 142 pushes the valve body 141 toward the first control room 118 with a force larger than an elastic force of the second coil spring 126, so that the control passage 120 is opened.

When the rotation speed of the engine 500 becomes stable and the engine 500 becomes in the steady operation state again, the control pressure ΔP between the second and third control rooms 124, 125 becomes 0. As a result, the control passage 120 is closed due to a pressure difference between the pressure inside the first control room 118 and the pressure inside the second control room 124.

The fourth embodiment is not limited to a compressor which reduces the discharge amount according to the rapid change of the pressure inside the suction room 106, similarly to the first and second embodiments. The fourth embodiment may be also applied to a compressor which reduces the discharge amount according to the rapid change of the pressure inside the discharge room 107, similarly to the third embodiment.

Although the present invention has been fully described in connection with preferred embodiments thereof with reference to the accompanying drawings, it is to be noted that various changes and modifications will become apparent to those skilled in the art.

For example, in each of the above-described embodiments, the second orifice 127 is used as a throttle hole of the compressor; however, any other throttle means in which a flow of refrigerant is restricted may be used instead of the second orifice 127. That is, any other throttle means for generating a larger flow resistance may be used.

Such changes and modifications are to be understood as being within the scope of the present invention as defined by the appended claims.

What is claimed is:

1. A compressor for a refrigerant cycle, driven by an engine for driving a vehicle, said compressor comprising:

a compression unit having an inlet for sucking refrigerant, an outlet for discharging refrigerant and a compression room in which refrigerant is sucked and compressed, said compression unit being rotated with a rotation of the engine; and a discharge-amount varying unit which varies an amount of refrigerant discharged from said compression unit, said discharge-amount varying unit including a first control room communicating with said inlet and outlet of said compression unit, a control passage through which either one of said inlet and outlet of said compression unit communicates with said first control room, a valve for opening and closing said control passage, a second control room for applying a pressure to said valve in a first direction for closing said control passage, a third control room for applying a pressure to said valve in a second direction for opening said control passage, and an elastic member which applies an elastic force to said valve in the first direction, wherein:

said discharge-amount varying unit reduces the discharge amount of refrigerant from said compression unit according to a pressure variation of said first control room;

either one of said inlet and outlet of said compression unit communicates with either one of said second control room and said third control room; and said second and third control rooms communicates with each other to have a pressure difference therebetween, when a rotation speed of said compression unit is accelerated.

2. The compressor according to claim 1, wherein said discharge-amount varying unit reduces the discharge amount of refrigerant from said compression unit when the pressure difference between said second and third control rooms becomes larger than a predetermined value.

3. The compressor according to claim 1, wherein:

said valve has throttle means for restricting a flow of refrigerant; and said second and third control rooms communicate with each other through said throttle means.

4. The compressor according to claim 1, wherein:

said discharge-amount varying unit has a housing for defining said second and third control rooms;

said housing has throttle means for restricting a flow of refrigerant; and said second and third control rooms communicate with each other through said throttle means.

5. The compressor according to claim 1, wherein:

said inlet of said compression unit communicates with said first control room through said control passage;

said discharge-amount varying unit has a bypass passage through which refrigerant flows from said compression room to said inlet of said compression unit, and a bypass valve for opening and closing said bypass passage; and said bypass valve opens said bypass passage, when the pressure inside said first control room decreases.

6. The compressor according to claim 1, wherein said compression unit is a scroll type in which said compression room is formed in a scroll shape.

7. The compressor according to claim 1, further comprising a shaft driven by the engine to be rotated, wherein:

said outlet of said compression unit communicates with said first control room through said control passage;

said first control room has therein an inclined plate which inclined relative to said shaft with a variable inclination angle, said inclination angle of said inclined plate being set to become larger when the pressure inside said first control room exceeds the pressure inside said inlet; and said discharge-amount varying unit decreases the discharge amount of refrigerant from said outlet of said compression unit, as said inclination angle of said inclined plate becomes larger.

8. The compressor according to claim 1, wherein:

said second control room communicates with said inlet of said compression unit.

9. The compressor according to claim 1, wherein said discharge-amount varying unit reduces the discharge amount of refrigerant from said compression unit when a rotation speed of the engine is accelerated.

10. The compressor according to claim 1, wherein said discharge-amount varying unit reduces the discharge amount of refrigerant from said compression unit when the vehicle is accelerated.

* * * * *